US011987929B2

(12) United States Patent
Li et al.

(10) Patent No.: US 11,987,929 B2
(45) Date of Patent: May 21, 2024

(54) TEXTILE MATERIALS CONTAINING DYED POLYPHENYLENE SULFIDE FIBERS AND METHODS FOR PRODUCING THE SAME

(71) Applicant: Milliken & Company, Spartanburg, SC (US)

(72) Inventors: Shulong Li, Spartanburg, SC (US); Richard A. Mayernik, Simpsonville, SC (US); William E. Baird, Jr., Inman, SC (US)

(73) Assignee: MILLIKEN & COMPANY, Spartanburg, SC (US)

( * ) Notice: Subject to any disclaimer, the term of this patent is extended or adjusted under 35 U.S.C. 154(b) by 0 days.

(21) Appl. No.: 17/881,221

(22) Filed: Aug. 4, 2022

(65) Prior Publication Data

US 2022/0389652 A1 Dec. 8, 2022

Related U.S. Application Data

(63) Continuation of application No. 15/970,304, filed on May 3, 2018, now abandoned, which is a continuation-in-part of application No. 15/785,772, filed on Oct. 17, 2017, now abandoned.

(60) Provisional application No. 62/418,731, filed on Nov. 7, 2016.

(51) Int. Cl.

| | |
|---|---|
| ***D06P 3/82*** | (2006.01) |
| ***D01H 1/02*** | (2006.01) |
| ***D01H 4/00*** | (2006.01) |
| ***D02G 3/04*** | (2006.01) |
| ***D03D 15/54*** | (2021.01) |
| ***D04B 1/16*** | (2006.01) |
| ***D04B 1/22*** | (2006.01) |
| ***D06P 1/00*** | (2006.01) |
| ***D06P 1/613*** | (2006.01) |
| ***D06P 1/645*** | (2006.01) |
| ***D06P 1/651*** | (2006.01) |
| ***D06P 1/653*** | (2006.01) |
| ***D06P 3/00*** | (2006.01) |
| ***D06P 3/54*** | (2006.01) |

(Continued)

(52) U.S. Cl.

CPC ..... *D06P 3/8204* (2013.01); *D02G 3/04* (2013.01); *D03D 15/54* (2021.01); *D04B 1/16* (2013.01); *D04B 1/225* (2013.01); *D06P 1/0032* (2013.01); *D06P 1/6133* (2013.01); *D06P 1/645* (2013.01); *D06P 1/65118* (2013.01); *D06P 1/65131* (2013.01); *D06P 1/6536* (2013.01); *D06P 3/004* (2013.01); *D06P 3/54* (2013.01); *D06P 3/6025* (2013.01); *D06P 3/6033* (2013.01); *D06P 5/02* (2013.01); *D01H 1/02* (2013.01); *D01H 4/00* (2013.01); *D06M 2200/30* (2013.01); *D06P 3/002* (2013.01); *D06P 3/6041* (2013.01); *D10B 2201/02* (2013.01); *D10B 2201/24* (2013.01); *D10B 2331/04* (2013.01); *D10B 2331/301* (2013.01); *D10B 2401/04* (2013.01); *D10B 2501/04* (2013.01); *D10B 2503/02* (2013.01); *D10B 2505/08* (2013.01); *D10B 2505/12* (2013.01)

(58) Field of Classification Search

CPC ..... D06P 3/8024; D06P 3/004; D06P 3/54; D06P 3/6025; D06P 3/6033; D06P 3/002; D06P 3/641; D03D 15/54; D04B 1/16; D04B 1/225; D10B 2201/02; D10B 2201/24; D10B 2331/301; D10B 2331/04; D10B 2503/02; D10B 2505/08; D10B 2505/12; D10B 2501/04; D10B 2401/04; D01H 4/00; D01H 1/02; D06M 2200/30

See application file for complete search history.

(56) References Cited

U.S. PATENT DOCUMENTS

| | | | |
|---|---|---|---|
| 4,199,321 | A | 4/1980 | Blackwell |
| 5,447,540 | A | 9/1995 | Kobayashi |
| 7,713,891 | B1 | 5/2010 | Li |

(Continued)

FOREIGN PATENT DOCUMENTS

| | | |
|---|---|---|
| CN | 101575759 | 11/2009 |
| CN | 101773302 A | 7/2010 |

(Continued)

OTHER PUBLICATIONS

Disperse Blue 139, Feb. 3, 2020, http://www.worlddyevariety.com/disperse-dyes/disperse-blue-139.html.*

(Continued)

*Primary Examiner* — Amina S Khan

(74) *Attorney, Agent, or Firm* — Cheryl J. Brickey

(57) ABSTRACT

A textile material comprises a plurality of yarns, wherein the yarns contain an intimate blend of dyed polyphenylene sulfide fibers and cellulosic fibers. The dyed polyphenylene sulfide fibers comprise a disperse dye that is distributed substantially evenly across the cross-sectional area of the fibers. A method for dyeing textile materials containing polyphenylene sulfide fibers comprises the steps of (a) providing a textile material comprising yarns which contain an intimate blend of polyphenylene sulfide fibers and cellulosic fibers, (b) providing a dye liquor comprising a liquid medium and a disperse dye, (c) applying the dye liquor to the textile material, (d) heating the textile material under ambient atmosphere to a temperature sufficient to evaporate substantially all of the liquid medium from the textile material, and (e) heating the textile material under ambient atmosphere to a temperature of about 180° C. or more to fix the disperse dye to the polyphenylene sulfide fibers.

5 Claims, No Drawings

(51) Int. Cl.
*D06P 3/60* (2006.01)
*D06P 5/02* (2006.01)

(56) References Cited

U.S. PATENT DOCUMENTS

| | | | | |
|---|---|---|---|---|
| 8,012,890 | B1 | 9/2011 | Li | |
| 8,012,891 | B2 | 9/2011 | Li | |
| 8,097,048 | B2 | 1/2012 | Kubo | |
| 8,722,551 | B2 | 5/2014 | Mayernik | |
| 8,732,863 | B2 | 5/2014 | Hines | |
| 8,741,789 | B2 | 6/2014 | Li | |
| 8,973,164 | B2 | 3/2015 | Hines | |
| 9,091,020 | B2 | 7/2015 | Li | |
| 9,212,434 | B2 | 12/2015 | Ulrich | |
| 9,453,112 | B2 | 9/2016 | Gerhardt | |
| 9,745,674 | B2 | 8/2017 | Hines | |
| 10,202,720 | B2 | 2/2019 | Cliver | |
| 2003/0082972 | A1* | 5/2003 | Monfalcone, III | D21H 21/34 428/920 |
| 2004/0029473 | A1* | 2/2004 | McKee | D03D 15/513 442/181 |
| 2004/0082694 | A1* | 4/2004 | Kubo | C08K 5/07 524/359 |
| 2006/0016045 | A1 | 1/2006 | Proud | |
| 2009/0234068 | A1 | 9/2009 | Horiuchi | |
| 2009/0253329 | A1 | 10/2009 | Shimizu | |
| 2011/0275263 | A1 | 11/2011 | Li | |
| 2012/0171918 | A1 | 7/2012 | Lawson, III | |
| 2013/0022780 | A1 | 1/2013 | Kawazoe | |
| 2013/0273283 | A1* | 10/2013 | Feng | C09K 21/14 428/401 |
| 2013/0273799 | A1 | 10/2013 | Luo | |
| 2015/0118931 | A1 | 4/2015 | Gerhardt | |
| 2017/0175302 | A1 | 6/2017 | Habicht | |
| 2018/0127916 | A1 | 5/2018 | Li | |
| 2018/0195214 | A1 | 7/2018 | Wirth | |
| 2018/0251939 | A1 | 9/2018 | Li | |
| 2019/0338462 | A1 | 11/2019 | Li | |

FOREIGN PATENT DOCUMENTS

| | | | | | |
|---|---|---|---|---|---|
| CN | 101824757 | A | * | 9/2010 | |
| CN | 101824757 | B | | 9/2011 | |
| CN | 103388267 | A | | 11/2013 | |
| CN | 103556351 | A | | 2/2014 | |
| CN | 104562343 | A | | 4/2015 | |
| CN | 104674405 | | | 6/2015 | |
| CN | 105780254 | | | 7/2016 | |
| CN | 107141477 | A | | 9/2017 | |
| EP | 1375574 | A1 | | 1/2004 | |
| JP | H01272883 | | | 10/1989 | |
| JP | H0271809 | | | 3/1990 | |
| JP | 2001055640 | A | | 2/2001 | |
| JP | 2002097291 | | * | 4/2002 | C08J 7/02 |
| JP | 2003278017 | A | | 10/2003 | |
| JP | 2003339503 | A | | 12/2003 | |
| JP | 2004244786 | A | | 9/2004 | |
| JP | 2004285517 | | | 10/2004 | |
| JP | 2007204859 | A | | 8/2007 | |
| JP | 2007298199 | | | 11/2007 | |
| KR | 100190932 | | * | 6/1999 | D06P 5/2055 |
| WO | 2012148031 | A1 | | 11/2012 | |
| WO | 2012157800 | A1 | | 11/2012 | |
| WO | WO 2012/149031 | | * | 11/2012 | D06B 11/0089 |
| WO | 2019188197 | | | 10/2019 | |

OTHER PUBLICATIONS

CI Disperse Blue 139, Feb. 3, 2020, https://www.chemicalbook.com/ChemicalProductProperty_EN_CB41212402.htm.*
Glacial acetic acid, https://www.chembk.com/en/chem/Glacial%20acetic%20acid, Mar. 11, 2023.*
https://www.chemicalbook.com/ChemicalProductProperty_EN_CB41212402.htm , Feb. 3, 2020, Disperse Blue 139.*
https://www.chemicalbook.com/ChemicalProductProperty_EN_CB7249002.htm, chlorobenzene, Mar. 11, 2023.*
"Final Report on the Safety Assessment of Disperse Yellow 3" Journal of the American College of Toxicology 15 (4):311-319, Lippincott-Raven Publishers. Philadelphia, Cosmetic Ingredient Review, 1996.
"Polyphenylene Sulfide (Pps): A Comprehensive Guide on High Heat Plastic" Omnexus. https://omnexus.specialchem.com/selection-guide/polyphenylene-sulfide-pps-plastic-guide, available before 2017. 7 pages.
"Structural and spectral characterizations of C.I. Disperse Blue 148 having a new crystalline form" 99 (2013) 489-495 of Dyes and Pigments, Hui-Fen Qian Yin-Ge Wang, Xiao-Chun Chen, Wei-Gang Ruan, Wei Huang, Jun. 18, 2013.
Ci Disperse Blue 139, Feb. 3, 2020, 2 pages, https://www.chemicalbook.com/ChemicalProductProperty_EN_CB41212402 htm.
Disperse Blue 139, Feb. 3, 2020, 10 pages, http://www.worlddyevariety.com/disperse-dyes/disperse-blue-139.html.
Disperse Orange 3 Material Safety Data Sheet (MSDS) available before Oct. 2017, 7 pages.
Disperse Red 167 Product Specifications Sheet, Parchem Fine & Specialty Chemicals, available before Oct. 2017, 1 page.
http://www.miltonplastics.com/index.php/Picture/show/8.html, Polyphenylene sulfide (PPS) Dec. 2, 2020, 7 pages.
http://www.worlddyevariety.com/disperse-dyes/disperse-blue-56.html, 14 pages.
https://www.cncolorchem.com/product/Disperse-Blue-2BLN.html, colorchem Disperse Blue 2BLN, Dec. 28, 2020, 22 pages.
Kanetsuna, H. et al. "The Thermosol Dyeing Of Poly Phenylene Sulphide And Poly Ether-Ether Ketone Fibers," Sen'l Gakkaishi, 48 (1992) 431-33.
Patent Cooperation Treaty International Search Report. dated Dec. 21, 2017. International Application No. PCT/US2017/056894. International Filing Date: Oct. 17, 2017, 4 pages.
Patent Cooperation Treaty International Search Report. dated Jul. 10, 2019. International Application No. PCT/US2019/026454. International Filing Date: Apr. 9, 2019, 4 pages.
Patent Cooperation Treaty PCT International Search Report. dated Aug. 9, 2019. International Application No. PCT/US2019/029362. International Filing Date: Apr. 26, 2019. 5 pages.
PCT/US2021/017264 7170WO PCT Search Report, dated Mar. 30, 2021. International Filing Date: Feb. 9, 2021, 4 pages.
PCT/US2021/017264 7170WO PCT Written Opinion, International Filing Date: Feb. 9, 2021, 7 pages.
www.colour-index.com/fingerprint/view/8931 by Society of Dyers and Colourists, "Disperse Blue 139", printed on Jan. 8, 2020, 2 pages.

* cited by examiner

TEXTILE MATERIALS CONTAINING DYED POLYPHENYLENE SULFIDE FIBERS AND METHODS FOR PRODUCING THE SAME

RELATED APPLICATIONS

This application is a Continuation of and claims priority to U.S. patent application Ser. No. 15/970,304 filed on May 3, 2018, now abandoned, which is a Continuation-In-Part of and claims priority to U.S. patent application Ser. No. 15/785,772 filed on Oct. 17, 2017, now abandoned, which claims priority to U.S. Provisional Patent Application 62/418,731 filed on Nov. 7, 2016, both of which are herein incorporated by reference in its entirety.

TECHNICAL FIELD OF THE INVENTION

This application relates to textile materials containing dyed polyphenylene sulfide fibers and methods for producing the same.

BACKGROUND

Polyphenylene sulfide is a thermoplastic polymer that exhibits a number of desirable properties. For example, polyphenylene sulfide exhibits resistance to heat, various chemicals (e.g., acids, alkalis, and bleaches), mildew, aging, UV exposure (e.g., sunlight), and abrasion. Due to its thermoplastic nature and the desirable properties, polyphenylene sulfide polymer has been extruded into fibers suitable for use in making textile materials. These polyphenylene sulfide fibers have been used in industrial textile materials, such as high temperature filtration media and automotive hose reinforcement, for many years. However, despite the many advantages offered by the polyphenylene sulfide polymer, the textile fibers made from the polymer have not found practical use in apparel or decorative textile applications. The main reason for this lack of use is that no practical means for dyeing polyphenylene sulfide fibers has been developed.

A need therefore remains for a method of dyeing polyphenylene sulfide fibers that produces fibers with the full range of colors and shades desired for apparel and decorative textile applications and exhibiting the colorfastness needed for such applications. The invention described in this application seeks to provide such a method and the dyed polyphenylene sulfide fibers produced by such a method.

BRIEF SUMMARY OF THE INVENTION

In a first embodiment, the invention provides a textile material comprising a plurality of yarns containing an intimate blend of dyed polyphenylene sulfide fibers and cellulosic fibers, wherein the polyphenylene sulfide fibers have a cross-sectional area, the polyphenylene sulfide fibers comprise a disperse dye that is distributed substantially evenly across the cross-sectional area of the fibers, and the disperse dye is selected from the group consisting of disperse dyes having a molar mass of about 350 g/mol or more, disperse dyes comprising a nitro group, and mixtures thereof.

In a second embodiment, the invention provides a method for dyeing polyphenylene sulfide fibers, the method comprising the steps of:

(a) providing a plurality of polyphenylene sulfide fibers and cellulosic fibers;

(b) forming the polyphenylene sulfide fibers and cellulosic fibers into a plurality of yarns comprising intimately blended polyphenylene sulfide fibers and cellulosic fibers;

(c) forming the plurality of yarns into a textile material;

(d) providing a dye liquor comprising a liquid medium and a disperse dye selected from the group consisting of disperse dyes having a molar mass of about 350 g/mol or more, disperse dyes comprising a nitro group, and mixtures thereof;

(e) applying the dye liquor to the textile material;

(f) heating the textile material under ambient atmosphere to a temperature sufficient to evaporate substantially all of the liquid medium from the textile material; and (g) heating the textile material under ambient atmosphere to a temperature of about 180° C. or more to fix the disperse dye to the polyphenylene sulfide fibers;

(h) optionally, treating the textile material with a flame retardant.

DETAILED DESCRIPTION OF THE INVENTION

In a first embodiment, the invention provides a textile material comprising a plurality of dyed polyphenylene sulfide fibers. The textile material of this first embodiment can take any suitable form. For example, the plurality of dyed polyphenylene sulfide fibers can be consolidated to provide a yarn. In such an embodiment, the yarn can contain other fibers in addition to the dyed polyphenylene sulfide fibers, as is described in further detail below. In another embodiment, the plurality of dyed polyphenylene sulfide fibers can be consolidated into a nonwoven textile material. The textile material can also be a woven textile material comprising a plurality of interlaced yarns, at least one of which contains the dyed polyphenylene sulfide fibers. The textile material can also be a knit textile material comprising one or more interlooped yarns, at least one of which contains the dyed polyphenylene sulfide fibers.

In another embodiment, the invention provides a textile material comprising a plurality of yarns, the yarns comprising an intimate blend of dyed polyphenylene sulfide fibers and cellulosic fibers. The textile material of this embodiment can take any suitable form. The textile material can also be a woven textile material comprising a plurality of interlaced yarns, at least one of which contains the dyed polyphenylene sulfide fibers. The textile material can also be a knit textile material comprising one or more interlooped yarns, at least one of which contains the dyed polyphenylene sulfide fibers.

The dyed polyphenylene sulfide fibers can comprise any suitable polyphenylene sulfide polymer. The polyphenylene sulfide polymer can have any suitable molar mass. Preferably, the polyphenylene sulfide polymer has a mass average molar mass of about 20,000 g/mol or more. More preferably, the polyphenylene sulfide polymer has a mass average molar mass of about 30,000 g/mol or more, about 40,000 g/mol or more, or about 50,000 g/mol or more. Preferably, the polyphenylene sulfide polymer has a mass average molar mass of about 100,000 g/mol or less. More preferably, the polyphenylene sulfide polymer has a mass average molar mass of about 80,000 g/mol or less, about 70,000 g/mol or less, or about 60,000 g/mol or less. In a particularly preferred embodiment, the polyphenylene sulfide polymer has a mass average molar mass of about 40,000 g/mol to about 60,000 g/mol. The polyphenylene sulfide polymer can have any suitable melt viscosity. Preferably, the polyphenylene sulfide polymer has a melt viscosity of about 1,000 poise or more when measured at 300° C. and an apparent shear rate of 400 $s^{-1}$ in accordance with ASTM Test Method 3835. More preferably, the polyphenylene sulfide polymer has a melt viscosity of about 1,000 poise to about 3,000 poise or about 1,000 poise to about 2,200 poise when measured as described above.

The polyphenylene sulfide polymer can exhibit any suitable degree of crystallinity. Preferably, the percent crystallinity of the polyphenylene sulfide polymer is 10% or more. More preferably, the percent crystallinity of the polyphenylene sulfide polymer is about 20% or more, about 25% or more, or about 30% or more. The percent crystallinity of the polyphenylene sulfide polymer preferably is about 80% or less. More preferably, the percent crystallinity of the polyphenylene sulfide polymer is about 75% or less. Thus, in a series of preferred embodiments, the percent crystallinity of the polyphenylene sulfide polymer is from 10% to about 80%, about 20% to about 80%, or about 30% to about 75%.

The dyed polyphenylene sulfide fibers of the textile material comprise at least one dye. The dye can be any suitable dye, but disperse dyes are particularly preferred. Preferably, the dye is a disperse dye selected from the group consisting of disperse dyes having a molar mass of about 350 g/mol or more, disperse dyes comprising a nitro group, and mixtures thereof. In another preferred embodiment, the dye is a disperse dye selected from the group consisting of disperse dyes having a molar mass of about 400 g/mol or more, disperse dyes comprising a nitro group, and mixtures thereof. While not wishing to be bound to any particular mechanism or theory, it has been observed that disperse dyes having a higher molar mass (e.g., about 350 g/mol or more or about 400 g/mol or more) and/or a polar nature (such as disperse dyes containing a nitro group) are capable of satisfactorily dyeing the polyphenylene sulfide fibers, whereas disperse dyes that do not possess either of these characteristics are not. For example, it has been observed that dyes that do not possess either of these characteristics do not become sufficiently fixed in the polyphenylene sulfide fiber. With the exception of nitrodiphenylamine disperse dyes, the disperse dye preferably has a boiling point of 590° C. or more, more preferably about 600° C. or more. With the exception of nitrodiphenylamine disperse dyes, the disperse dye preferably has a flash point of 300° C. or more, more preferably about 310° C. or more. In a particular embodiment, the disperse dye has a boiling point of 590° C. or more (e.g., about 600° C. or more) and a flash point of 300° C. or more (e.g., about 310° C. or more).

The disperse dye can be any suitable disperse dye that possesses one or more of the characteristics described above. In a more specific preferred embodiment, the disperse dye is selected from the group consisting of azo dyes (e.g., azothiophene dyes, azobenzothiazole dyes), diazo dyes, anthraquinone dyes, nitro dyes (e.g., nitrodiphenylamine dyes), quinoline dyes, dibenzofuran dyes, naphthalimide dyes (e.g., aminoketone dyes), and mixtures thereof. Specific disperse dyes that have been found useful in dyeing the polyphenylene sulfide fibers include, but are not limited to, C.I. Disperse Red 356, C.I. Disperse Red 167, C.I. Disperse Blue 77, C.I. Disperse Orange 30, C.I. Disperse Orange 44, C.I. Disperse Red 91, C.I. Disperse Blue 77, C.I. Disperse Blue 27, C.I. Disperse Blue 60, C.I. Disperse Yellow 86, C.I. Disperse Yellow 42, C.I. Disperse Yellow 58, C.I. Disperse Yellow 163, C.I. Disperse Red 86, C.I. Disperse Violet 57, C.I. Disperse Red 159, C.I. Disperse Red 279, C.I. Disperse Yellow 114, C.I. Disperse Blue 56, C.I. Disperse Blue 165, C.I. Disperse Red 153, C.I. Disperse Brown 1, C.I. Disperse Violet 33, C.I. Disperse Red 92, and C.I. Disperse Blue 87. Any of the above-mentioned dyes can be used in combination to produce polyphenylene sulfide fibers and textile materials exhibiting the desired color and shade.

The disperse dye preferably is distributed substantially evenly throughout the thickness of the polyphenylene sulfide fibers. In other words, the disperse dye preferably is distributed substantially evenly across the cross-sectional area of the polyphenylene sulfide fibers. This distribution of the disperse dye within the polyphenylene sulfide fibers is believed to be unique. For example, prior attempts to dye polyphenylene sulfide fibers have relied upon surrounding the polyphenylene sulfide polymer with a sheath of an easily-dyed polymer (e.g., a polyamide). In such products, the dye only penetrates and fixes in the sheath, and the polyphenylene sulfide polymer remains undyed (or contains very little dye at the interface between the polyphenylene polymer and the sheath). The distribution of the disperse dye through the thickness or across the cross-sectional area can be determined by any suitable technique. For example, individual polyphenylene sulfide fibers can be sectioned and the coloration of the fibers can be examined, for instance, using an optical microscope. When the coloration of the fibers is observed to be substantially even through the thickness or across the cross-sectional area of the fibers, one has confirmed that the dye is substantially evenly distributed through the thickness or across the cross-sectional area of the fiber.

The textile material described above can contain other fibers in addition to the polyphenylene sulfide fibers. In such embodiments, the textile material can further comprise any suitable natural fiber or synthetic fiber or combination of natural fibers and/or synthetic fibers. These additional fibers can be intimately blended with the polyphenylene sulfide fibers within the textile material. For example, the textile material can be a yarn in which the polyphenylene sulfide fibers are intimately blended with, for example, cellulosic fibers. Alternatively, the additional fibers and the polyphenylene fibers can be present in separate elements within the textile material. For example, the textile material can comprise a first yarn containing the polyphenylene sulfide fibers and a second yarn containing, for example, cellulosic fibers.

As noted above, the textile material can comprise any suitable natural or synthetic fiber(s) in addition to the polyphenylene sulfide fibers. In a preferred embodiment, the textile material further comprises cellulose fibers. The cellulose fibers used in such an embodiment can be natural cellulose fibers (e.g., cotton fibers), regenerated cellulose fibers, or any combination thereof. Suitable regenerated cellulose fibers include, but are not limited to, rayon fibers (e.g., viscose rayon fibers, high wet modulus rayon fibers, modal fibers, and polynosic fibers), lyocell fibers, and mixtures thereof.

When the textile material comprises cellulose fibers, the textile material can further comprise a flame retardant that is added to improve the flame resistance of the cellulose fibers and the textile material containing the same. In such embodiments, any suitable flame retardant can be used. Preferably, the flame retardant is a phosphorus-based flame retardant, such as the flame retardants based on tetrahydroxymethlphosphonium salts and condensates thereof. Suitable examples of such flame retardants include, but are not limited to, those flame retardants described in U.S. Pat. Nos. 7,713,891; 8,012,890; 8,012,891; 8,722,551; 9,091,020; 9,453,112; and U.S. Patent Application Publication No. US 2015/0118931 A1, each of which is hereby incorporated by reference.

The yarns making up the textile material and the textile material can contain any suitable amounts of polyphenylene sulfide fibers and cellulosic fibers. Preferably, the plurality of yarns comprises at least about 40% by weight polyphenylene sulfide fibers. In another embodiment, the plurality of yarns comprises at least about 50% by weight polyphenylene sulfide fibers. In another embodiment, the plurality of yarns comprises between about 20 and 80% by weight polyphenylene sulfide fibers, more preferably between about 40 and 70% weight. In another embodiment, the plurality of yarns comprises between about 20 and 80% by weight cellulosic fibers, more preferably between about 40 and 70% weight.

Preferably, the textile material comprises at least about 40% by weight polyphenylene sulfide fibers. In another embodiment, the textile material comprises at least about 50% by weight polyphenylene sulfide fibers. In another embodiment, the textile material comprises between about 20 and 80% by weight polyphenylene sulfide fibers, more preferably between about 40 and 70% weight. In another embodiment, the textile material comprises between about 20 and 80% by weight cellulosic fibers, more preferably between about 40 and 70% weight.

In the embodiment where the plurality of yarns comprise polyphenylene sulfide fibers and cellulosic fibers, the yarn size is preferably less than 22 cotton count, more preferably between about 10 and 20 cotton count.

The textile material can also comprise synthetic fibers (about 0 to 20%, preferably 0-10% by weight, in another embodiment about 0.5% to 20%, preferably 0.5%-10% by weight) in addition to the polyphenylene sulfide fibers, such as thermoplastic synthetic fibers and/or inherent flame resistant fibers. Suitable thermoplastic synthetic fibers include, but are not necessarily limited to, polyester fibers (e.g., poly(ethylene terephthalate) fibers, poly(propylene terephthalate) fibers, poly(trimethylene terephthalate) fibers), poly (butylene terephthalate) fibers, and blends thereof), polyamide fibers (e.g., nylon 6 fibers, nylon 6,6 fibers, nylon 4,6 fibers, and nylon 12 fibers), polyvinyl alcohol fibers, and combinations, mixtures, or blends thereof. Preferably, the thermoplastic synthetic fibers are selected from the group consisting of polyester fibers, polyamide fibers, and mixtures thereof.

When the textile material comprises thermoplastic synthetic fibers, the textile material can further comprise a flame retardant that is added to improve the flame resistance of the thermoplastic synthetic fibers and the textile material containing the same. Any flame retardant suitable for use with thermoplastic synthetic fibers can be used in such embodiments.

As utilized herein, the term "inherent flame resistant fibers" refers to synthetic fibers which, due to the chemical composition of the material from which they are made, exhibit flame resistance without the need for an additional flame retardant treatment. In such embodiments, the inherent flame resistant fibers can be any suitable inherent flame resistant fibers, such as polyoxadiazole fibers, polysulfonamide fibers, poly(benzimidazole) fibers, aramid fibers (e.g., meta-aramid fibers and para-aramid fibers), polypyridobisimidazole fibers, polybenzylthiazole fibers, polybenzyloxazole fibers, melamine-formaldehyde polymer fibers, phenol-formaldehyde polymer fibers, oxidized polyacrylonitrile fibers, polyamide-imide fibers and combinations, mixtures, or blends thereof. In a preferred embodiment, the textile material comprises aramid fibers in addition to the polyphenylene sulfide fibers.

The textile materials described above are believed to be well-suited for use in applications where the textile material must meet certain requirements for flame resistance. For example, the textile material can be a fabric used in the manufacture of curtains or window treatments, which fabric should meet the most stringent requirements of NFPA 701. The textile material can also be used in the manufacture of upholstery and furniture fabrics, automotive fabrics (e.g., woven, knit, or nonwoven textiles used in automotive applications), aircraft interiors, etc.

In a second embodiment, the invention provides a method for dyeing polyphenylene sulfide fibers. The method generally comprises the steps of: (a) providing a textile material comprising polyphenylene sulfide fibers; (b) providing a dye liquor comprising a liquid medium and a disperse dye; (c) applying the dye liquor to the textile material; (d) heating the textile material under ambient atmosphere to a temperature sufficient to evaporate substantially all of the liquid medium from the textile material; and (e) heating the textile material under ambient atmosphere to a temperature sufficient to fix the disperse dye to the polyphenylene sulfide fibers.

In another embodiment, the invention provides a method for dyeing textile materials containing yarns which comprise polyphenylene sulfide fibers and cellulosic fibers. The method generally comprises the steps of: (a) providing a plurality of polyphenylene sulfide fibers and cellulosic fibers; (b) forming the polyphenylene sulfide fibers and cellulosic fibers into a plurality of yarns comprising intimately blended polyphenylene sulfide fibers and cellulosic fibers; (c) forming the plurality of yarns into a textile material; (d) providing a dye liquor comprising a liquid medium and a disperse dye selected from the group consisting of disperse dyes having a molar mass of about 350 g/mol or more, disperse dyes comprising a nitro group, and mixtures thereof; (e) applying the dye liquor to the textile material; (f) heating the textile material under ambient atmosphere to a temperature sufficient to evaporate substantially all of the liquid medium from the textile material; (g) heating the textile material under ambient atmosphere to a temperature of about 180° C. or more to fix the disperse dye to the polyphenylene sulfide fibers; and (h) treating the textile material with a flame retardant.

In a preferred embodiment, the polyphenylene sulfide fibers and the cellulosic fibers are intimately blended together and formed into yarns. Intimately blended means that the two types of fibers are not formed into separate yarns and then twisted together, but that the yarn contains both polyphenylene sulfide fibers and the cellulosic fibers entangled with each other. Preferably, the yarns are formed by the process of spinning, wherein the process of spinning is selected from the group consisting of open-end, ring, jet, vortex, rotor-spun, and Siro-spun spinning. Most preferred are the vortex spinning and ring spinning processes. In ring spinning, the ring yarn has consistent fiber orientation. Most of the fibers look to be oriented to the same angle, so most of the fibers help contribute to the yarn strength. Open end spinning is an alternative to ring spinning. Unlike the fiber orientation seen in ring spun yarns, the fiber orientation in an open end yarn tends to be more random and inconsistent.

The textile material utilized in the method can be any suitable textile material comprising polyphenylene sulfide fibers, such as any of the textile materials described above. In one preferred embodiment, the textile material is formed into a garment for a user to wear.

As noted above, the dye liquor comprises a liquid medium and a disperse dye. The liquid medium can be any liquid medium suitable for use with disperse dyes. Typically, the liquid medium is an aqueous medium, such as water. The liquid medium can comprise a surfactant or wetting agent in order to improve wetting of the polyphenylene sulfide fibers with the dye liquor. In a preferred embodiment, the dye liquor has a pH of about 4 to about 7.5, more preferably about 5 to about 7.

The disperse dye present in the dye liquor can be any of the disperse dyes discussed above in connection with the textile material of the invention. In a preferred embodiment, the dye liquor further comprises a volatile organic acid having a boiling point of about 100° C. to about 170° C. Suitable examples of such volatile organic acids include, but are not limited to, acetic acid, formic acid, propionic acid, butyric acid, and mixtures thereof. While not wishing to be bound to any particular theory, it is believed that such volatile organic acids improve the color yield of the dyeing process, especially when the dye is fixed at temperatures of 180° C. or more. Further, with a boiling point of 100° C. to 170° C., it is believed that the organic acid vaporizes during the dye fixation step and does not leave any harmful residue on the fibers.

In a preferred embodiment, the dye liquor further comprises a dye carrier. Suitable dye carriers include, but are not limited to, propylene glycol, ethylene glycol, dipropylene glycol, tripropylene glycol, diethylene glycol, triethylene glycol, benzoic acid, triethanolamine, polyethylene oxide, polyethylene glycol, copolymers of ethylene oxide and propylene oxide, and mixtures thereof. While not wishing to be bound to any particular theory, it is believed that such dye carriers can assist in dye solubilization and/or dye penetration and diffusion into the polyphenylene sulfide fibers.

The dye liquor can be applied to the textile material in any suitable fashion and using any suitable apparatus. Typically, the textile material is passed through a bath of the dye liquor so that it is saturated with the dye liquor. Upon exiting the bath, the textile material can be passed through one or more nip rollers, which apply pressure to the textile material and remove excess dye liquor before the drying step. Alternatively, the dye liquor can be sprayed directly onto the surface of the textile material.

Following application of the dye liquor, the textile material is heated under ambient atmosphere to a temperature sufficient to evaporate substantially all of the liquid medium (and any volatile organic acid and/or dye carrier in the dye liquor) from the textile material. The textile material can be heated to any suitable temperature in this step. Preferably, the textile material is heated to a temperature greater than 40° C., more preferably 100° C., 130° C., or 140° C.

Following the drying step, the textile material is heated to a temperature sufficient to fix the dye in the polyphenylene sulfide fibers. This dye fixation step preferably is performed under ambient atmosphere, meaning that the step is not performed in a closed system under elevated pressure. The textile material can be heated to any suitable temperature in order to fix the dye. Preferably, the textile material is heated to a temperature of 160° C. or more. More preferably, the textile material is heated to a temperature of about 180° C. or more or about 190° C. or more. The textile material preferably is not heated to a temperature greater than 260° C. because such temperatures have been observed to cause adverse dye degradation. In a preferred embodiment, the textile material is heated to a temperature of about 180° C. to about 260° C., more preferably about 190° C. to about 240° C.

Following the dye fixation step, the textile material can be further treated in order to remove and/or neutralize any unfixed disperse dye that remains on the textile material. Thus, in a preferred embodiment, the method described above further comprises the step of treating the textile material from step (e) with a caustic solution to remove or neutralize unfixed disperse dye on the textile material. The textile material can be treated with the caustic solution in any suitable manner. For example, the textile material can be immersed in a bath of the caustic solution (maintained at a temperature of 40° C. to about 80° C.) for a sufficient amount of time to remove and/or neutralize the unfixed dye. Alternatively, the textile material can be impregnated with the caustic solution and then steamed. The caustic solution preferably comprises a reducing agent that is capable of reducing any unfixed disperse dye to an uncolored form. Suitable reducing agents include, but are not limited to, sodium bisulfite. Following treatment with the caustic solution as described above, the textile material is then washed in water to remove the dye residues and dried.

When the textile material comprises other fibers in addition to the polyphenylene sulfide fibers, the method described above can be modified in order to dye the additional fibers. For example, when the textile material comprises cellulose fibers in addition to the polyphenylene sulfide fibers, the dye liquor can further comprise one or more vat dyes, which will dye the cellulose fibers. The method can also be preceded or succeeded by a series of steps that dye the additional fibers. For example, when the textile material comprises polyester fibers, the textile material can be jet dyed using disperse dyes in order to impart the desired color and shade to the polyester fibers. In such an embodiment, the textile material can be jet dyed before or after dyeing in accordance with the method described above. Alternatively, the polyester fibers and the polyphenylene sulfide fibers can be dyed simultaneously using the method described above using one or more suitable disperse dyes. In such an embodiment, one can select a single disperse dye having the appropriate properties to dye both the polyphenylene sulfide fibers and the polyester fibers, or one can use a mixture of disperse dyes, at least one of which possesses the appropriate properties (as described above) to dye the polyphenylene sulfide fibers.

The following examples further illustrate the subject matter described above but, of course, should not be construed as in any way limiting the scope thereof.

Example 1

This example demonstrates the production of textile materials according to the invention.

Dye liquors were produced using the components listed in Table 1 below.

TABLE 1

Composition of dye liquors.

| Dye Liquor 1 | Dye Liquor 2 | Dye Liquor 3 | Dye Liquor 4 |
|---|---|---|---|
| 10% propylene glycol | 10% propylene glycol | 10% propylene glycol | 10% propylene glycol |
| 1% Triton X-705 | 1% Triton X-705 | 1 % Triton X-705 | 1% Triton X-705 |
| 87.5% di water | 87.5% di water | 87.5% di water | 87.5% di water |
| 1% Burcosperse Navy C2G | 1% Qualsperse Rubine 3BSK | 1% Qualsperse Blue BNS | 1% Terasil Yellow GWL |
| 0.5% acetic acid | 0% acetic acid | 0.5% acetic acid | 0.5% acetic acid |
| pH = 3.2 | pH = 5.5 | pH = 3.3 | pH = 3.3 |

Navy C2G is a mixture containing C.I. Disperse Blue 291 and a minor amount of an orange disperse dye. Disperse Blue 291 is an azo dye containing two nitro groups. The molar mass of Disperse Blue 291 is 509 g/mol. Qualsperse Rubine 3BSK is a commercially available version of C.I. Disperse Red 167. Disperse Red 167 is an azo dye containing a nitro group. Disperse Red 167 has a molar mass of 505.9 g/mol, a boiling point of 713° C., and a flash point of 385° C. Qualsperse Blue BNS is a water dispersion of C.I. Disperse Blue 60. Disperse Blue 60 is an anthraquinone dye having a molar mass of 379 g/mol, a boiling point of 681° C., and a flash point of 363° C. Terasil Yellow GWL is a water dispersion of C.I. Disperse Yellow 42. Disperse Yellow 42 is a diphenylamine dye containing a nitro group. Disperse Yellow 42 has a molar mass of 369 g/mol, a boiling point of 548° C., and a flash point of 285° C.

Several pieces of a polyphenylene sulfide nonwoven textile material were impregnated with a dye liquor containing approximately 1% by weight of the disperse dye described in Table 1. The wet pick-up of the dye liquor was approximately 50% owf. After impregnation with the dye liquor, the nonwoven textile materials were dried at a temperature of approximately 120° C. (250° F.) to remove water and then placed in a lab convection oven set at (215° C.) 420° F. The nonwoven textile materials were left in the oven for approximately 6 minutes.

After heating, the nonwoven textile materials were then immersed in an aqueous solution containing 3% sodium hydroxide and 6% sodium bisulfite. The aqueous solution was maintained at a temperature of approximately 60° C., and the nonwoven textile materials were left in the solution for approximately 20 minutes. The nonwoven textile materials were then rinsed with water several times and immersed in a 5% hydrogen peroxide solution. The hydrogen peroxide solution was maintained at a temperature of approximately 50° C., and the nonwoven textile materials were left in the solution for approximately 10 minutes. After treatment with the hydrogen peroxide solution, the nonwoven textile materials were then rinsed with water several times and finally dried at a temperature of approximately 120° C. (250° F.)

The dyeing procedure described above was repeated on similar nonwoven textile materials using similar dye liquors containing other disperse dyes. These disperse dyes are listed and described in Table 2 below. Table 2 also includes the properties for some of the dyes used in making Dye Liquors 1-4.

TABLE 2

Disperse dyes used in treating nonwoven materials and their molar masses (in g/mol), boiling points (B.P., in ° C.), and flash points (F.P., in ° C.).

| Disperse dyes | Molar mass | B.P. | F.P. | Chemical structure | Light fastness |
|---|---|---|---|---|---|
| Disperse Red 356 | 412 | | | 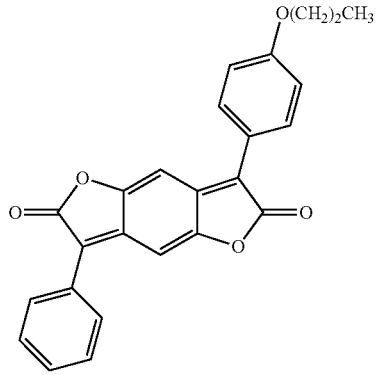 | 4 |
| Disperse Red 167 | 505.9 | 713.2 | 385.1 | 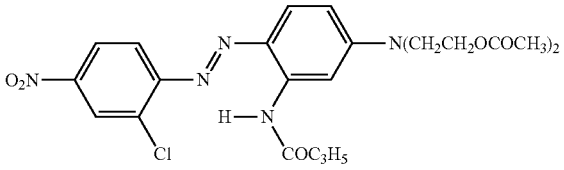 | 4 |
| Disperse Blue 77 | 376 | 625 | 332 | 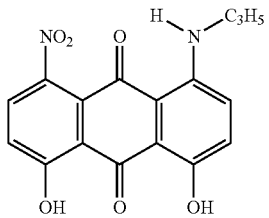 | 3 |

TABLE 2-continued
Disperse dyes used in treating nonwoven materials and their molar masses (in g/mol), boiling points (B.P., in ° C.), and flash points (F.P., in ° C.).
| Disperse dyes | Molar mass | B.P. | F.P. | Chemical structure | Light fastness |
|---|---|---|---|---|---|
| Disperse Orange 30 | 450 | 645 | 344 | 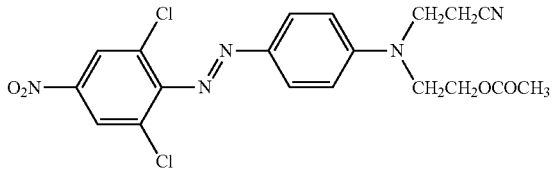 | 4 |
| Disperse Orange 44 | 382.8 | 663 | 355 | 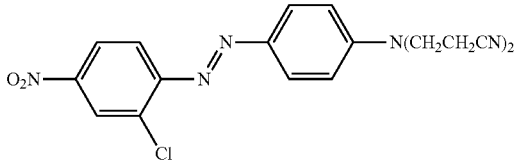 | 4 |
| Disperse Red 91 | 355 | 638 | 340 | 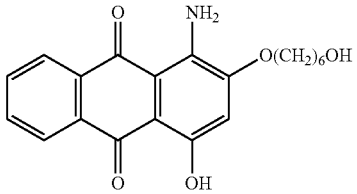 | 3.5 |
| Disperse Blue 77 | 376 | 625 | 332 | 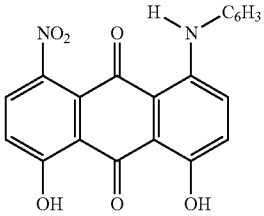 | 3 |
| Disperse Blue 27 | 420 | 681 | 366 | 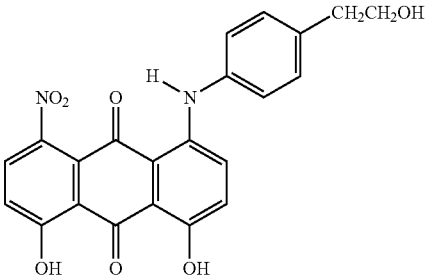 | 3 |
| Disperse Blue 60 | 379 | 677 | 363 | 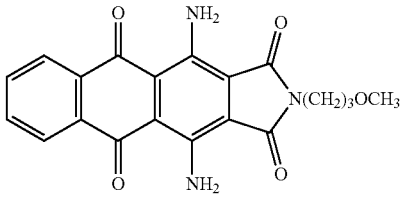 | 3 |

TABLE 2-continued

Disperse dyes used in treating nonwoven materials and their molar masses (in g/mol), boiling points (B.P., in ° C.), and flash points (F.P., in ° C.).

| Disperse dyes | Molar mass | B.P. | F.P. | Chemical structure | Light fastness |
|---|---|---|---|---|---|
| Disperse Yellow 86 | 365 | 510 | 262 | 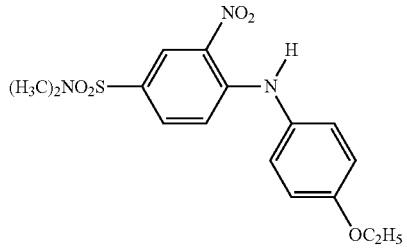 | 4 |
| Disperse Yellow 42 | 369 | 548 | 285 | 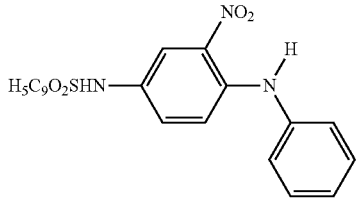 | 3 |

The nonwoven textile materials dyed using the procedure described above exhibit excellent coloration. The polyphenylene sulfide fibers in the nonwoven showed a uniform coloration throughout the cross-section of the fibers, which is indicative of high color yield and excellent dye fixation. The dyed nonwoven textile materials also showed virtually no color loss after 5 washes. Further, the lightfastness of the dyed nonwoven textile materials was measured in accordance with AATCC Test Method 16.3, which is entitled "Colorfastness to Light: Xenon-Arc." In particular, the lightfastness of dyed nonwoven textile materials was measured after 20 hours of exposure to the xenon lamp. The results of these measurements for several disperse dyes are set forth in Table 2 above.

Knit fabrics made using a filament polyphenylene sulfide fiber were dyed in accordance with the procedure described above using some of the dye liquors described above. These dyed knit fabrics exhibited similar properties to the dyed nonwoven textile materials.

Example 2

This example demonstrates the production of a textile material according to the invention.

Polyphenylene sulfide fibers and cotton fibers were blended and spun together by ring spinning method to yield a 20 count single ply yarn. The yarn contained 65% polyphenylene sulfide fibers and 35% cotton fibers by weight. Several of these yarns were then woven together to produce a 3×1 twill fabric having fabric weight of approximately 203 g/m$^2$ (6 oz/yd$^2$). The fabric was then impregnated with an aqueous dye liquor containing a mixture of vat dyes (to dye the cotton) and a mixture of disperse dyes (to dye the polyphenylene sulfide fibers). The composition of the dye liquor is set forth in Table 3 below.

TABLE 3

Dye liquor composition.

| Component | Amount (g/L) |
|---|---|
| Lumachrom Orange SCZ (C.I. Disperse Orange 30) | 5.0 |
| Qualsperse Rubine 3BSK (C.I. Disperse Red 167) | 2.1 |
| Qualsperse Blue BNS (C.I. Disperse Blue 60) | 4.5 |
| Antimigrant HC-M1 | 21 |
| Acetic acid | 1.5 |
| Yellow PG (Vat dye) | 6.6 |
| Roycevat Brown BR (vat dye) | 4.6 |
| Navinon Olive TM (Vat dye) | 5.3 |
| Water | Balance of each liter |

Following immersion in the dye liquor, the fabric was dried at approximately 120° C. (250° F.) for approximately 3 minutes to remove the water. The fabric was then placed in a lab convection oven set at (215° C.) 420° F. The fabric was left in the oven for approximately 5 minutes. The fabric was then cooled.

The fabric was next immersed in an aqueous solution containing 3% sodium hydroxide and 6% sodium bisulfite. The fabric was then placed in a saturated steamer for approximately 3 minutes, followed by rinsing in hot water and immersion in a 6% hydrogen peroxide solution. The fabric was lastly rinsed in hot water.

The resulting fabric had a bright orange color with uniform color appearance. The dyed fabric also exhibited good crocking fastness (dry crocking rating of 4-5), lightfastness, and washfastness.

Example 3

A 200 denier 50 continuous filament polyphenylene sulfide yarn (manufactured by Toray Industry Company) was knitted into a tubular structure using a small gauge circular knitting machine. The knitted tube was washed in a washing machine to remove any contaminant oils on the fabric. The washed knit was dried at 380° F. for 5 minutes in a lab convection oven. The dried knit is then impregnated with aqueous solution containing about 2% Terasil Yellow GWL and 0.2% acetic acid solution. The impregnated knit is then dried in a lab convection oven at 250° F. to remove water, then placed in a lab convection oven at 420° F. for 3 minutes. The fabric was next immersed in an aqueous solution containing 3% sodium hydroxide and 6% sodium bisulfite to remove any unfixed dyed on the fiber surfaces. The dyed fabric exhibited uniform yellow shade, with good color fastness.

The fabric was then tested for flame resistance in accordance with ASTM D6413 Standard Test Method for Flame Resistance of Textiles (Vertical Test). The fabric exhibited 0 second of afterflame and a char length of approximately 4 inches. However, the fabric completely melted away in the area exposed to the flame. The fabric having 100% polyphenylene sulfide fiber content is thus believed to be less desirable (or unsuitable) as a flame resistant protective apparel fabric, due to the melting away characteristic.

Example 4

65% by weight PPS fiber and 35% by weight long staple cotton fiber are blended uniformly, and spun into single ply yarn with 20 yarn count. Both ring spinning and open-end spinning methods were used to make the intimately blended yarns. The yarns were separately used to form 3×1 left hand twill fabrics with fabric weight about 5.5 oz/yard$^2$ after removing the size on the yarns. The fabrics were dyed a navy color using a mixture of disperse dye and vat dye in a dyeing process as described in Example 2. The dyed fabrics were then treated with tetrakis(hydroxymethyl)phosphonium flame retardant in a process as described in U.S. Pat. No. 8,012,891 (which is herein incorporated by reference). The treated fabrics were tested for flame resistance according to ASTM D6413 test method. The results are shown in the following:

Vertical Flame Test Results

| Vertical Flame Test Results | Ring spun | Open end |
|---|---|---|
| Char length | 3.7" warp/3.1" fill | 4.3" warp |
| Afterflame, sec | 0 | 0 |
| Afterglow, sec | 0 | 0 |
| Observations | No observable melting away or flaming drips. | No observable melting away or flaming drips. |

With the intimate blend of 35% cotton with 65% polyphenylene sulfide fiber, the fabric exhibited no melting away when exposed to flame (while 100% polyphenylene sulfide fabric did as shown in Example 3). Also, the fabric made using ring spun yarn has a short char length below 4 inches in both warp and fill directions of the woven fabric, indicating only a short length of thermal damage by flame and heat after 12 seconds flame exposure in the vertical flame test. The fabric made from ring spun yarns is well suited for a flame resistant protective apparel fabric. Considering the thermoplastic nature of the polyphenylene sulfide fiber, the observed melt-away phenomenon in Example 3, and polyphenylene sulfide fiber being the majority of the blend, such short char lengths were not normally expected. The char length of fabric made of ring spun yarns is significantly shorter than similar fabric made of open-end spun yarns. Yarns made using vortex spinning are expected to behave similarly to the ring spun yarn due to their similar yarn structures.

Heat stability tests for regular flame resistance protective clothing fabrics were also conducted on the above fabrics by placing the fabric into a convection oven at 500° F. for 5 minutes. Fabric shrinkages were measured after the heat exposure and reported below.

| | | |
|---|---|---|
| Observations | No melt, no charring | No melt, no charring |
| Shrinkage, % | 2.5% warp/2.0% fill | 7% warp/1% filling |

As shown above, both fabrics have less than 10% shrinkages, and the fabric made from ring spun yarns has lower thermal shrinkages.

Example 5

Similar to fabrics described in Example 4, except that fabrics were made using 40% by weight polyphenylene sulfide fibers and 60% by weight cotton intimate fiber blends.

Vertical Flame Test Results

| | Ring Spun Yarn | Open-end Yarn |
|---|---|---|
| Char length | 5.0" warp/3.6" fill | 4.1" warp/3.7" fill |
| Afterflame, sec | 0 | 0 |
| Afterglow, sec | 0 | 0 |

Example 6

Similar to Example 4 except that 62% by weight cotton, 15% PPS by weight and 23% by weight polyester fibers were blended to make an open-end spun yarn, and a woven fabric was made using the yarn. Vertical flame test results of the fabric were a char length of 5.9" warp/5.0" fill, an afterflame of 0 sec, and an afterglow of 0 sec.

Example 7

The 65%/35% (by weight) PPS/Cotton open-end spun yarn from Example 4 was used as the warp yarn, and an open-end spun yarn of 65% polyester and 35% cotton (polycotton yarn) was used as the filling yarn. A 3×1 left hand twill fabric is made using the warp yarn and the filling such that the polycotton yarns are disposed mostly on the face of the fabric and the PPS/cotton yarns are disposed mostly on the back side of the fabric. After treating with tetrakis(hydroxymethyl)phosphonium flame retardant in a process as described in U.S. Pat. No. 8,012,891, the fabric exhibits flame resistance as indicated by the vertical flame test results of char length of 5.7" warp/4.7" fill, an afterflame of 0 sec, and an afterglow of 0 sec.

All references, including publications, patent applications, and patents, cited herein are hereby incorporated by reference to the same extent as if each reference were individually and specifically indicated to be incorporated by reference and were set forth in its entirety herein.

The use of the terms “a” and “an” and “the” and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A method for dyeing textile materials containing polyphenylene sulfide fibers, the method comprising the steps of:

(a) providing a plurality of polyphenylene sulfide fibers and cellulosic fibers, wherein the polyphenylene sulfide fibers comprise polyphenylene sulfide having a percent crystallinity from about 20% to about 80%, a melt viscosity of about 1,000 poise or more when measured at 300° C. and an apparent shear rate of 400 $s^{-1}$ in accordance with ASTM Test Method 3835;

(b) ring spinning the polyphenylene sulfide fibers and cellulosic fibers into a plurality of yarns comprising blended polyphenylene sulfide fibers and cellulosic fibers;

(c) forming the plurality of yarns into a textile material;

(d) providing a dye liquor comprising a liquid medium and a disperse dye selected from the group consisting of disperse dyes having a molar mass of about 350 g/mol or more, disperse dyes comprising a nitro group and mixtures thereof, wherein the disperse dye has a flash point of 300° C. or more, and wherein the dye liquor further comprises a volatile organic acid having a boiling point of about 100° C. to about 170° C. and a dye carrier selected from the group consisting of propylene glycol, ethylene glycol, dipropylene glycol, tripropylene glycol, diethylene glycol, triethylene glycol, benzoic acid, triethanolamine, polyethylene oxide, polyethylene glycol, copolymers of ethylene oxide and propylene oxide;

(e) applying the dye liquor to the textile material;

(f) treating the textile material from step (e) with a caustic solution comprising sodium bisulfite to remove or neutralize unfixed disperse dye on the textile material;

(g) heating the textile material under ambient atmosphere to a temperature sufficient to evaporate substantially all of the liquid medium from the textile material;

(h) heating the textile material under ambient atmosphere to a temperature of about 180° C. or more to fix the disperse dye to the polyphenylene sulfide fibers; and;

(i) treating the textile material with a phosphorus-based flame retardant.

2. The method of claim 1, wherein the cellulosic fibers comprise cotton fibers.

3. The method of claim 1, wherein the textile material is a woven textile material or a knit textile material.

4. The method of claim 1, wherein the yarns comprise at least about 40% by weight of polyphenylene sulfide fibers.

5. The method of claim 1, wherein the textile material comprises between about 20 and 80% by weight polyphenylene sulfide fibers and between about 80 and 20% by weight cellulosic fibers.

* * * * *